US006161243A

United States Patent [19]

Weihrauch

[11] Patent Number: 6,161,243

[45] Date of Patent: Dec. 19, 2000

[54] TOOTHBRUSH AND METHOD FOR ITS MANUFACTURE

[75] Inventor: Georg Weihrauch, Wald-Michelbach, Germany

[73] Assignee: Coronet-Werke GmbH, Wald-Michelbach, Germany

[21] Appl. No.: 09/043,141

[22] PCT Filed: Sep. 4, 1996

[86] PCT No.: PCT/EP96/03873

§ 371 Date: Aug. 11, 1998

§ 102(e) Date: Aug. 11, 1998

[87] PCT Pub. No.: WO97/09907

PCT Pub. Date: Mar. 20, 1997

[30] Foreign Application Priority Data

Sep. 13, 1995 [DE] Germany ..... 195 33 815

[51] Int. Cl.[7] ..... B29C 47/04; D02G 3/38

[52] U.S. Cl. ..... 15/167.1; 15/207.2; 264/177.17; 264/177.13; 264/210.8; 264/339; 264/177.19; 428/373

[58] Field of Search ..... 15/167.1, 207.2; 264/177.17, 177.13, 210.8, 339, 177.19; 428/373, 377, 397, 364

[56] References Cited

U.S. PATENT DOCUMENTS

| | | |
|---|---|---|
| 3,239,867 | 3/1966 | Charvat . |
| 4,373,541 | 2/1983 | Nishioka . |
| 4,807,938 | 2/1989 | Weihrauch . |
| 4,958,402 | 9/1990 | Weihrauch . |
| 5,313,909 | 5/1994 | Tseng et al. . |
| 5,725,954 | 3/1998 | Montsinger . |

FOREIGN PATENT DOCUMENTS

| | | |
|---|---|---|
| 531551 | 10/1956 | Canada . |
| 1140901 | 12/1962 | Germany . |
| 3-289906 | 12/1991 | Japan . |
| 6-233709 | 8/1994 | Japan . |

*Primary Examiner*—Deborah Jones
*Assistant Examiner*—Jennifer McNeil
*Attorney, Agent, or Firm*—Antonelli, Terry, Stout & Kraus, LLP

[57] ABSTRACT

A toothbrush has a brush head and plastic bristles, optionally combined into bundles, fixed thereto and whereof at least some bristles have a profile on their circumferential surface. In order in the case of unchanged strength characteristics of the bristles to obtain an increased cleaning and massaging action, the bristles have a helix as the profile. The bristles can comprise a core and at least one helix running over the circumferential surface. For the manufacture of the toothbrush it is possible to extrude and then twist a profiled monofilament or a monofilament with axially parallel ribs and then fix the twist. It is also possible to co-extrude a monofilament made from one plastic with ribs made from a plastic having other characteristics running over its circumferential surface, followed by the twisting of the co-extruded composite and the fixing of the twist.

21 Claims, 1 Drawing Sheet

TOOTHBRUSH AND METHOD FOR ITS MANUFACTURE

BACKGROUND OF THE INVENTION

The invention relates to a toothbrush with a brush head and with plastic bristles and to a method for the manufacture of a plastic bristle for such a toothbrush.

In the case of toothbrushes either manually or electrically operated, the bristles conventionally comprise extruded monofilaments with a circular cross-section. Other cross-sections have already been proposed. The cleaning action of such toothbrushes, as well as a desired massaging action of the gums, takes place almost exclusively through the bristle ends which are rounded to avoid gum recession and injury. To this extent the bristle end has to fulfill two opposing requirements, namely on the one hand exerting an adequate brushing action on the tooth and on the other bringing about a restrained massaging of the gums. The cleaning of the tooth surfaces and gaps between the teeth which is vital is consequently inadequate due to the compromises made.

Numerous attempts have been made to incorporate the circumferential surface of the bristle by profiling into the brushing process and consequently increases the cleaning action. Thus, it is known (DE 31 16 189) to provide the bristle with different, spaced thickenings, which form further brushing edges. It is scarcely possible to rationally manufacture such a brush, if it is borne in mind that bristles are conventionally produced by spinning or extruding. Admittedly it is theoretically possible to bring about cross-sectional changes in the extrusion direction enabling such a bristle to be produced by extrusion. The monofilaments produced by extrusion must be subsequently finished and namely stretched and heat stabilized, to give the bristle the desired bendability and the necessary re-righting capacity. Such stretching in the case of injection moulded or extruded bristles with spaced thickenings would only lead to the bristle being stretched and constricted in the vicinity of the narrowest cross-sections between the thickenings, whereas the latter would be uninfluenced. Such a bristle would be completely unusable. Even if it proved possible to provide such a bristle with the necessary characteristics, the danger would exist of the bristle with the thickenings jamming in the interdental spaces and on pulling either tearing off or tearing out at the bristle head or injuring the gums in the interdental space, where they are particularly endangered due to inadequate dental neck adhesion.

In other toothbrush constructions (JP 03 289 906 A, JP 56-116 124 U, JP 60-145 828 U, JP 03-87332 U) either several monofilaments are twisted together or the individual monofilaments, which are themselves profiled, e.g. have a square cross-section (JP 03-289 906 A, JP 57-116 124 U), are profiled by helical twisting of the monofilament axis. This bristle has a better cleaning action as a result of its three-dimensionally twisted, sharp edges. The profile of this bristle is not suitable for dental care as a result of the numerous narrow turns and the resulting plurality of edges, which ineffectively slide over and beyond the comparatively smooth surface, but can injure the gums. The plurality of turns leads to large number of bending-weak points, which can impair the re-righting capacity of the bristle. The molecular structure of the monofilament is also impaired by the strong twisting. Such a bristle also easily become hooked in the interdental spaces.

SUMMARY OF THE INVENTION

The problem of the invention is to propose a toothbrush with profiled bristles which, in the case of unchanged strength characteristics, have an increased, but at the same time gentle cleaning and massaging action and which can be inexpensively manufactured.

According to the invention, the problem is solved by using bristles having a core and at least one helix passing over the circumferential surface and having three to five turns per cm of length and by having the head of the helix rounded.

The inventive bristle can be manufactured by extrusion and finished in the same way as a conventional bristle. It has the advantage that in addition to the bristle end the head of the bristle or its transition to the flanks and the flanks themselves form additional brushing edges due to the considerable helix pitch and which reinforce the cleaning action on the tooth surfaces and interdental spaces, without damaging the gums. Even when such a bristle penetrates the interdental spaces there can be no bristle jamming effect, because the helix is very stable and there are no radial constrictions. In addition, as a result of the small number of pitches, the helix can twist up in the case of tension, so that no extraction forces act on the bristle which would be higher than in the case of conventional bristles.

Due to the fact that the core or monofilament axis is not helically twisted, the core gives the bristle conventional characteristics, namely the necessary bendability and the necessary re-righting capacity. As a result of the comparatively steep pitch of the helix the number of active edges on the circumference is limited, so that in spite of the improved cleaning action in conjunction with the rounded head of the helix, there is still an adequately gentle working of the teeth and a gentle massaging action on the gums. The rounding of the helix head can preferably take place at the time of extrusion of the monofilament, but can also take place subsequently by mechanical or heat treatment.

In an advantageous construction, at least one part of the bristles can have a single or multiple-pitch helix, so that the surfaces active during cleaning are enlarged and at the same time different action directions are obtained.

The bristle constructed according to the invention in all cases exerts a stronger scraping, abrasive action on the dental enamel and gums than conventional bristles of substantially cylindrical monofilaments and consequently is unsuitable for users having very sensitive gums or dental necks, as a result of the different colours of the helix and core the characteristics of the brush are indicated to the user, so that he can choose a toothbrush adapted to his needs. The plastic for the helix can be coloured by pigments. As the pigment particles can be harder than the plastic matrix, through the colouring alone the helix is given a certain abrasive action.

Preferably the core and the at least one helix are made from different materials. Thus, the at least one helix can be adapted to specific use conditions, particularly with regards to its hardness. Here again by a different colour design of the core and helix, the user can be provided information on the characteristics of the particular brush. Such bristles can also be obtained in simple manner in that the monofilament has a polygonal, preferably square cross-section. Then, after twisting, each edge forms a helix.

In the case of certain brushes it is necessary for the bristles to have a predetermined stiffness or elasticity. According to a preferred development of the invention, a stiffness adaptation can be achieved if the core is provided with an outer core and an envelope surrounding the outer core made from different materials. Through the choice of the materials for the outer core and the envelope the stiffness and elasticity of the bristles on the one hand and their action in dental care on the other can be influenced and varied in desired manner. The ribs on the envelope can either be made from the material thereof or from a different material.

According to a further development of the invention, the monofilament or monofilaments are made from an elastic plastic. In this way the bristles made from the bristle material can expand longitudinally, which leads to a reduction of their diameter, so that e.g. following introduction into an interdental space, they can be more easily extracted therefrom and do not jam therein. Jamming is prevented in that the bristle can twist on extraction.

If necessary, the bristles may only have a helix over part of their length. In order to adapt the action of a brush to given framework conditions, spiral bristles can be combined with bristles of other configurations and processed together.

For the manufacture of a bristle for a toothbrush having the aforementioned construction, the invention proposes that a monofilament with at least one axially parallel rib is extruded, twisted and then the twist is fixed. The bristles can then be manufactured by cutting to length from a continuous strand.

Another method comprises a monofilament made from one plastic being co-extruded together with ribs running over its circumferential surface made from a plastic having other characteristics, followed by the twisting of the co-extruded composite and finally the twist is fixed.

This method also permits a continuous manufacture of the bristle material. The plastic forming the helix can also be adapted to the intended use. For example, the core can be made from the plastic conventionally used for bristles, whereas the plastic used for the helix is made softer or harder or can be provided with abrasive fillers. The plastic forming the helical ribs can also have a different colouring, so as to permit a functional indication.

The core can also be made from zonally different materials, so as to adapt the bristle to its intended use. The core has a inner area and an envelope surrounding said inner area made from different materials and which are co-extruded.

Another manufacturing possibility consists of extruding at least two monofilaments, which are then twisted and the twist is then fixed. During extrusion or after twisting, the monofilaments can be non-detachably interconnected.

The bristle according to the invention also offers the possibility of the extruded monofilament or the co-extruded composite being stretched prior to twisting and optionally stabilized, in order to give the bristle with the helix the characteristics necessary for bristles used in toothbrushes.

Finally, as in conventional bristles, it is advantageous if the monofilament or the co-extruded composite, following twisting, are heat stabilized and then stored for 24 to 48 h.

In the case of toothbrushes, the bristle ends must be rounded after trimming, in order to avoid damage to teeth and injuries to the gums. This advantageously takes place by the surface melting of the bristle ends, because the ends of the thin-walled helix melt before the core and consequently the sharp edges initially re-form.

A bristle manufactured according to one of the aforementioned methods is also eminently suitable as or for interdental cleaners. In the case of an interdental cleaner other advantages arise, if it is only twisted in one area of its length. The untwisted area has smaller cross-sectional dimensions and can consequently more easily be introduced into an interdental space. Introduction can be further facilitated if the untwisted area at least zonally has a cross-section flattened e.g. by pressing.

In order to ensure a completely satisfactory and extraction-resistant fixing of the bristles to the brush body, the bristles individually or groupwise are melted at their fastening-side end onto a head and anchored therewith in the brush body. As a result the fastening-side end has a uniform spherical or lenticular cross-section permitting a completely satisfactory anchoring in the brush head.

BRIEF DESCRIPTION OF THE DRAWINGS

The invention is described in greater detail hereinafter relative to embodiments and the attached drawings, wherein show.

DETAILED DESCRIPTION OF THE PREFERRED EMBODIMENTS

Figure 1:
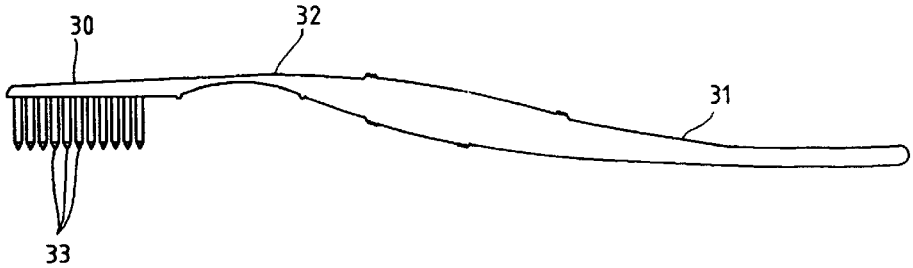
FIG. 1 A diagrammatic side view of a toothbrush.

The toothbrush according to FIG. 1 has a head 30 and a handle 31, which are interconnected by means of a flexible neck 32. The head 30, handle 31 and neck 32 are injection moulded from plastic in one piece. Bristles in the form of bundles 33 are fixed to the head 30. The bundles 33 are only diagrammatically indicated and in each case comprise a plurality of plastic bristles, which are fixed by welding, injecting or mechanically to the head 30.

Figure 2:
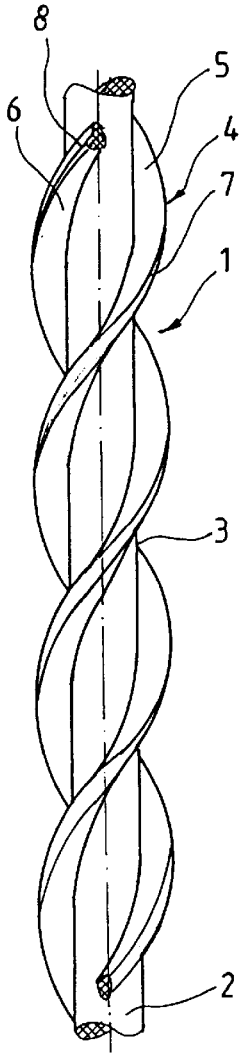
FIG. 2 A larger scale detail view of a bristle.

FIG. 2 shows a single bristle 1 from a bundle 33. It comprises a circular cylindrical core 2, on whose circumferential surface is provided a two-pitch helix 4 with the two helixes 5, 6, Each helix 5, 6 has a flattened or rounded head 7 or 8. Such a bristle for toothbrushes can e.g. have an external diameter of approximately 0.2 mm, the core 2 having a diameter of approximately 0.1 to 0.15 mm. For the bristle length of up to 1.5 cm conventionally used for toothbrushes, the helix has a pitch of 2 to 6.

The bristle according to FIG. 2 can be manufactured in different ways. For example, a monofilament 9 according to FIG. 3 can be extruded, stretched, twisted and finally heat fixed with a core 10 and two diametrically positioned ribs 11, 12, so as to give a two-pitch helix according to FIG. 2. FIG. 4 shows an extruded monofilament 9 with an approximately triangular cross-section formed by a core 13 and three ribs 14, 15, 16. FIG. 5 shows a monofilament 9 with a cruciform cross-section, which once again has a core 17 and four symmetrically arranged ribs 18, 19, 20 and 21. The twist axis in all the embodiments coincides with the axis of the core 2. The monofilament can also have a substantially rectangular, e.g. square cross-section, the core area close to the centre and the four corner regions forming the ribs.

Figure 3:
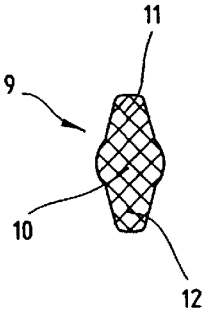
FIGS. 3 to 5 Different cross-sectional shapes of an extruded monofilament.
Figure 4:
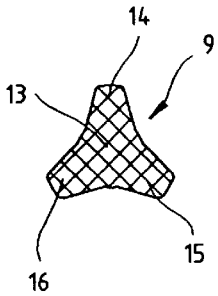
Figure 5:
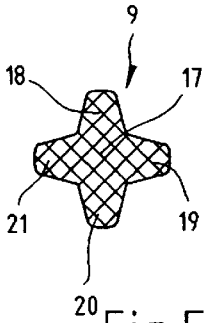
Figure 6:
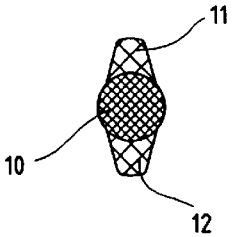
FIGS. 6 to 11 Different cross-sectional shapes of a co-extruded composite.
Figure 7:
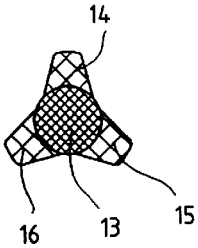
Figure 8:
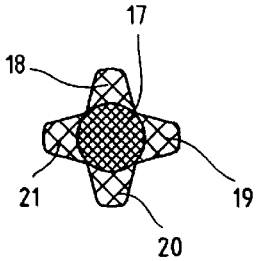

FIGS. 6 to 8 show in substantially the same cross-sectional forms as FIGS. 3 to 5, but in this case the circular cylindrical cores 10, 13, 17 are co-extruded with the ribs 11, 12 and 14 to 16 or 18 to 21. The extruded monofilament or the co-extruded composite is then stretched, twisted and heat stabilized and stored for 1 to 2 days.

Figure 9:
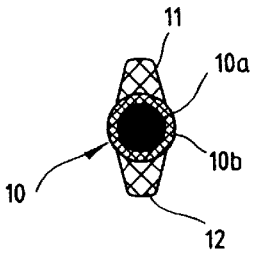
Figure 10:
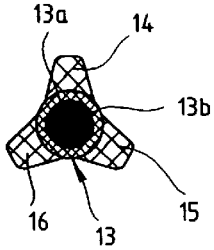
Figure 11:
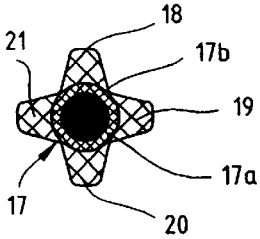

FIGS. 9 to 11 show similar cross-sectional shapes to FIGS. 6 to 8, but the cores 10, 13, 17 have an outer core 10*a*, 13*a* and 17*a* and surrounding the latter envelops 10*b*, 13*b* and 17*b*. The outer core and envelope are made from different materials. The ribs 11, 12 or 14 or 16 or 18 to 21 are made from a further material. The outer core is co-extruded with the envelope and the ribs and is subsequently worked in the indicated manner. The outer core 10*a*, 13*a* and 17*a* can be made from a typical plastic for toothbrush bristles, in order to ensure all the positive strength characteristics of a conventional bristle, whereas the plastics material for the envelope 10*b*, 13*b*, 17*b* and for the ribs 11, 12 or 14 to 16 or 18 to 21 can be matched to the desired cleaning and/or massaging action.

As can in particular be gathered from FIGS. 3 to 11 and as described relative to FIG. 2, the head of the ribs is flattened or rounded. After cutting the bristles to length from the continuous material, the use-side ends are rounded, preferably by surface premelting, whereas the fastening-side ends are individually or groupwise melted to a head.

Instead of the cross-section shown, the bristle 1 or the monofilament from which it is made, can also have a rectangular and preferably square cross-section. After twisting, the edges of said cross-section form in each case a rib.

What is claimed is:

1. Toothbrush comprising a brush head and a plurality of plastic bristles fixed thereto, at least some of the plastic bristles comprising a core and at least one helix passing over a circumferential surface of the core and having three to five turns per cm of length, a head of the at least one helix being rounded, wherein each of the plastic bristles comprising a core and at least one helix is formed by twisting a monofilament having at least one rib along a surface thereof, and wherein the helix and core have different colours.

2. Toothbrush according to claim 1, characterized in that at least part of the plastic bristles comprising a core and at least one helix includes a multiple-pitch helix.

3. Toothbrush according to claim 1, characterized in that the helix has a substantially trapezoidal cross-section.

4. Toothbrush according to claim 1, characterized in that the monofilaments are made from elastic plastic.

5. Toothbrush according to claim 1, characterized in that each of the plastic bristles comprising a core and at least one helix only has a helix over part of its length.

6. Toothbrush according to claim 1, wherein the helix and the core are made from the same material.

7. Toothbrush according to claim 1, wherein the monofilament has a square cross-section, the four corner regions of which form the ribs.

8. Toothbrush comprising a brush head and a plurality of plastic bristles fixed thereto, at least some of the plastic bristles comprising a core and at least one helix passing over a circumferential surface of the core and having three to five turns per cm of length, a head of the at least one helix being rounded, wherein each of the plastic bristles comprising a core and at least one helix is formed by twisting a monofilament having at least one rib along a surface thereof, and wherein the helix and core are made from different materials.

9. Toothbrush comprising a brush head and a plurality of plastic bristles fixed thereto, at least some of the plastic bristles comprising a core and at lest one helix passing over a circumferential surface of the core and having three to five turns per cm of length, a head of the at least one helix being rounded, wherein each of the plastic bristles comprising a core and at least one helix is formed by twisting a monofilament having at least one rib along a surface thereof, and wherein the core has an outer core and an envelope surrounding said outer core made from different materials.

10. Method for the manufacture of a plastic bristle for a toothbrush comprising extruding a profiled monofilament or a monofilament with at least one axially parallel rib twisting the extruded monofilament over at least part of its length to provide a bristle having a core and at least one helix passing over a circumferential surface of the core and having three to five turns per cm of length, fixing the twist, and rounding a head of the helix.

11. Method according to claim 10, further comprising stretching the extruded monofilament prior to twisting.

12. Method according to claim 10, further comprising thermally stabilizing the monofilament after twisting.

13. Method according to claim 12, further comprising storing the twisted monofilament at an increased temperature after thermal stabilization.

14. Method according to claim 10, further comprising rounding a use-side end of each bristle surface melting.

15. Method according to claim 10, further comprising melting the bristles individually or groupwise on their fastening-side end to a brush head and anchoring the bristles in the brush head.

16. Method for the manufacture of a plastic bristle for a toothbrush comprising coextruding a monofilament made from one plastic together with at least one rib made from a plastic having different characteristics, twisting the coextruded composite over at least part of its length to provide a bristle having a core and at least one helix passing over the circumferential surface of the core and having three to five turns per cm of length, fixing the twist, and rounding a head of the helix.

17. Method according to claim 16, further comprising stretching the extruded composite prior to twisting.

18. Method according to claim 16, further comprising thermally stabilizing the coextruded composite after twisting.

19. Method according to claim 16, further comprising storing the twisted composite at an increased temperature after thermal stabilization.

20. Method according to claim 16, further comprising rounding a use-side end of each bristle surface melting.

21. Method according to claim 16, further comprising melting the bristles individually or groupwise on their fastening-side end to a brush head and anchoring the bristles in the brush head.

* * * * *